US010440465B2

(12) United States Patent
Peace, Jr. et al.

(10) Patent No.: US 10,440,465 B2
(45) Date of Patent: Oct. 8, 2019

(54) MULTIPLE PATH ACOUSTIC WALL COUPLING FOR SURFACE MOUNTED SPEAKERS

(71) Applicant: HARMAN INTERNATIONAL INDUSTRIES, INCORPORATED, Stamford, CT (US)

(72) Inventors: Paul Wayne Peace, Jr., Viejo, CA (US); Derrick Rodgers, Altadena, CA (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 16/069,799

(22) PCT Filed: Jan. 16, 2017

(86) PCT No.: PCT/US2017/013649

§ 371 (c)(1),
(2) Date: Jul. 12, 2018

(87) PCT Pub. No.: WO2017/124067

PCT Pub. Date: Jul. 20, 2017

(65) Prior Publication Data

US 2019/0020937 A1 Jan. 17, 2019

Related U.S. Application Data

(60) Provisional application No. 62/278,952, filed on Jan. 14, 2016, provisional application No. 62/278,959, filed on Jan. 14, 2016.

(51) Int. Cl.
*H04R 1/24* (2006.01)
*H04R 1/02* (2006.01)
(Continued)

(52) U.S. Cl.
CPC ..... *H04R 1/24* (2013.01); *H04R 1/025* (2013.01); *H04R 1/22* (2013.01); *H04R 1/2857* (2013.01);
(Continued)

(58) Field of Classification Search
CPC ..... G10K 11/17815; G10K 11/17823; G10K 11/17854; G10K 11/17881;
(Continued)

(56) References Cited

U.S. PATENT DOCUMENTS 5,844,176 A 12/1998 Clark
6,257,365 B1 7/2001 Hulsebus, II
(Continued)

FOREIGN PATENT DOCUMENTS

CN 1235688 A 11/1999
CN 1324556 A 11/2001
(Continued)

OTHER PUBLICATIONS

Non-Final Office Action for U.S. Appl. No. 16/069,797, dated Jul. 10, 2019, 10 pages.
(Continued)

*Primary Examiner* — Curtis A Kuntz
*Assistant Examiner* — Julie X Dang
(74) *Attorney, Agent, or Firm* — Brooks Kushman P.C.

(57) ABSTRACT

A surface mounted loudspeaker design is provided that mitigates the interference between direct low frequency (LF) energy and reflected LF energy by breaking the LF energy from an LF driver into multiple paths using one or more of waveguides, driver load plates, and enclosure ports to diffuse the reflected energy and minimize frequency response errors. One or more embodiments of the present disclosure provides a loudspeaker have multiple acoustic exits strategically designed and located to generate, for example, three
(Continued)

major wave front arrivals—2 source and 1 reflection—at target angles with favorable lag times, mitigating the cancellation notching and frequency errors that occur in conventional loudspeaker designs.

20 Claims, 7 Drawing Sheets

(51) Int. Cl.

| | |
|---|---|
| ***H04R 1/34*** | (2006.01) |
| ***H04R 5/02*** | (2006.01) |
| ***H04R 1/22*** | (2006.01) |
| ***H04R 3/04*** | (2006.01) |
| ***H04R 9/06*** | (2006.01) |
| ***H04R 1/28*** | (2006.01) |

(52) U.S. Cl.
CPC ..... *H04R 1/345* (2013.01); *H04R 3/04* (2013.01); *H04R 5/02* (2013.01); *H04R 9/063* (2013.01); *H04R 2201/405* (2013.01)

(58) Field of Classification Search
CPC . G10K 2210/1282; G10K 2210/12821; G10K 2210/3026; G10K 2210/3028; H04R 1/24; H04R 1/2842; H04R 1/288; H04R 1/345; H04R 1/02; H04R 1/26; H04R 1/2834; H04R 1/2853; H04R 1/323; H04R 1/347; H04R 2201/021; H04R 2499/13; H04R 25/00; H04S 1/002; H04S 3/002
USPC ..... 381/160, 337, 339, 340, 345, 381, 386
See application file for complete search history.

(56) References Cited

U.S. PATENT DOCUMENTS

| | | | | |
|---|---|---|---|---|
| 6,981,570 | B2 | 1/2006 | Dalbec | |
| 7,010,138 | B1 | 3/2006 | Harris et al. | |
| 7,136,498 | B1 | 11/2006 | Schott | |
| 7,513,332 | B2 | 4/2009 | Moore | |
| 7,735,599 | B2 | 6/2010 | Kubota | |
| 8,995,697 | B2 | 3/2015 | Gladwin et al. | |
| 9,084,056 | B2 | 7/2015 | Flavignard et al. | |
| 9,204,212 | B2 | 12/2015 | Adams | |
| 2004/0042627 | A1 | 3/2004 | Ryan et al. | |
| 2004/0125969 | A1 | 7/2004 | Kieltyka et al. | |
| 2004/0252856 | A1 | 12/2004 | Masuda | |
| 2005/0217927 | A1 | 10/2005 | Noselli et al. | |
| 2006/0285712 | A1* | 12/2006 | Butler | H04R 1/24 381/340 |
| 2007/0086615 | A1* | 4/2007 | Cheney | H04R 1/345 381/338 |
| 2009/0310808 | A1 | 12/2009 | Button et al. | |
| 2010/0254558 | A1* | 10/2010 | Meyer | H04R 1/323 381/345 |
| 2011/0019862 | A1 | 1/2011 | Smith et al. | |
| 2011/0085692 | A1 | 4/2011 | Voishvillo | |
| 2012/0140971 | A1 | 6/2012 | Clements | |
| 2013/0058518 | A1 | 3/2013 | Held | |
| 2014/0105426 | A1* | 4/2014 | Fincham | H04S 1/002 381/160 |
| 2015/0063621 | A1 | 3/2015 | Lilley, Jr. | |
| 2015/0365758 | A1 | 12/2015 | Bridge | |
| 2016/0119711 | A1 | 4/2016 | DeLay et al. | |
| 2017/0347191 | A1 | 11/2017 | Button | |
| 2018/0262836 | A1 | 9/2018 | Janes | |

FOREIGN PATENT DOCUMENTS

| | | | | |
|---|---|---|---|---|
| CN | 1575031 | A | 2/2005 | |
| CN | 1666566 | A | 9/2005 | |
| CN | 1765148 | A | 4/2006 | |
| CN | 204145714 | U | 2/2015 | |
| CN | 104837090 | A | 8/2015 | |
| CN | 204652635 | U | 9/2015 | |
| JP | 2012049663 | A | 3/2012 | |
| WO | 2015094115 | A1 | 6/2015 | |
| WO | 2015105809 | A1 | 7/2015 | |
| WO | WO-2015105809 | A1 * | 7/2015 | H04R 5/02 |

OTHER PUBLICATIONS

Chinese Office Action for Application No. 201780006479.1, dated Jun. 12, 2019, 6 pages.
Chinese Office Action for Application No. 201780006489.5, dated Jul. 2, 2019, 6 pages.

* cited by examiner

MULTIPLE PATH ACOUSTIC WALL COUPLING FOR SURFACE MOUNTED SPEAKERS

CROSS-REFERENCE TO RELATED APPLICATIONS

This application is the U.S. national phase of PCT Application No. PCT/US2017/013649 filed on Jan. 16, 2017, which claims priority to U.S. provisional application Ser. No. 62/278,952 filed Jan. 14, 2016 and U.S. provisional application Ser. No. 62/278,959 filed Jan. 14, 2016, the disclosures of which are hereby incorporated in their entirety by reference herein.

TECHNICAL FIELD

The present disclosure relates to a multiple path acoustic wall coupling for surface mounted speakers.

BACKGROUND

An acoustic source radiates energy into its surroundings. If this source is an engineered loudspeaker, its radiated energy has an envelope shaped to present uniform energy to the audience. The ability of a loudspeaker to control its radiated energy in this way is diminished at lower frequencies, where wavelengths are larger than the loudspeaker itself, and acoustic energy radiates in all directions equally. In this case, the loudspeaker is said to be omnidirectional.

A surface mounted loudspeaker generates two distinct acoustic energy arrivals, one direct from the transducer and the other reflected from the surface to which it is mounted. The interference of the reflected energy with the direct energy is primarily destructive by creating dramatic frequency response errors. The frequency of these errors is directly related to the time difference between the two energy arrivals at the listener.

SUMMARY

One or more embodiments of the present disclosure is directed to a loudspeaker comprising a speaker enclosure and a low-frequency (LF) driver disposed in the speaker enclosure. The speaker enclosure may be adapted for surface-mounting and include a front surface having at least one front acoustic exit facing a target direction and a rear surface having at least one rear acoustic exit adapted to face a wall surface. The low-frequency (LF) driver may be adapted to emit LF acoustic energy that exits at least the front acoustic exit and the rear acoustic exit. The LF acoustic energy exiting the front acoustic exit and radiating directly in the target direction may form a first LF energy wave front. The LF acoustic energy exiting the front acoustic exit and reflecting off the wall surface may form a second LF energy wave front that lags the first LF energy wave front. The LF acoustic energy exiting the rear acoustic exit and radiating directly in the target direction combined with the LF acoustic energy exiting the rear acoustic exit and reflecting off the wall surface may form a third LF energy wave front that arrives between the first LF energy wave front and the second LF energy wave front.

According to one or more embodiments, the first LF energy wave front may have a magnitude of 0.80. The second LF energy wave front may have a magnitude of 0.50 and lag the first LF energy wave front by 3.70 milliseconds.

The third LF energy wave front may have a magnitude of 1.65 and lag the first LF energy wave front by 1.35 milliseconds.

The speaker enclosure may further comprise at least one side surface having a side acoustic exit. The LF acoustic energy exiting the side acoustic exit and radiating in the target direction may form part of the first LF energy wave front, while the LF acoustic energy exiting the side acoustic exit and reflecting off the wall surface may form part of the second LF energy wave front that lags the first LF energy wave front. The at least one side surface having a side acoustic exit may include two side surfaces, each side surface having the side acoustic exit.

The speaker enclosure may further comprise a bottom surface having a bottom acoustic exit. The LF acoustic energy exiting the bottom acoustic exit and radiating directly in the target direction combined with the LF acoustic energy exiting the bottom acoustic exit and reflecting off the wall surface may form part of the third LF energy wave front that arrives between the first LF energy wave front and the second LF energy wave front.

The loudspeaker may further include an LF waveguide coupled to the LF driver defining a first radiation path for the LF acoustic energy, wherein the at least one front acoustic exit includes the LF waveguide. The at least one front acoustic exit may include a front opening in the speaker enclosure above the LF waveguide. The LF waveguide may have a proximal opening positioned adjacent to the LF driver and extending away from the LF driver to a distal opening to define the first radiation path. The proximal opening may have a proximal opening area that is smaller than a radiating surface opening area to define a second radiation path for the LF acoustic energy around the LF waveguide and out the front opening. The loudspeaker may further comprise a load plate directly in front of a bottom portion of the radiating surface and adjacent the LF waveguide to deflect a portion of the LF acoustic energy along a third radiation path to the rear acoustic exit.

One or more additional embodiments of the present disclosure may be directed to a loudspeaker comprising a speaker enclosure, an LF driver, an LF waveguide, and a load plate. The speaker enclosure may include a front surface having a front acoustic exit, at least one side surface having a side acoustic exit, a rear surface having at least one rear acoustic exit, and a bottom surface having a bottom acoustic exit. The LF driver may be disposed in the speaker enclosure and have a radiating surface adapted to emit LF acoustic energy and a radiating surface opening defined by an outer circumference of the radiating surface. The LF waveguide may define a first radiation path for the LF acoustic energy. The LF waveguide may have a proximal opening positioned adjacent to the LF driver and extending away from the LF driver to a distal opening to define the first radiation path. The proximal opening may have a proximal opening area that is smaller than a radiating surface opening area to define a second radiation path for the LF acoustic energy around the LF waveguide and out the front acoustic exit and the side acoustic exit. The load plate may be directly in front of a bottom portion of the radiating surface and adjacent the LF waveguide to deflect a portion of the LF acoustic energy along a third radiation path to the rear acoustic exit and the bottom acoustic exit.

A target axis of the loudspeaker may be approximately 30° down from horizontal. Alternatively, a target axis of the loudspeaker may be between 30° and 60° down from horizontal.

The loudspeaker may further include at least one high-frequency (HF) driver disposed in the speaker enclosure. The at least one HF driver may include a first HF driver coupled to a first HF waveguide and a second HF driver coupled to a second HF waveguide. The LF waveguide, the first HF waveguide, and the second HF waveguide may be formed from a triple waveguide body. The first HF driver may be disposed in front of the radiating surface of the LF driver and at least partially obstructing the LF acoustic energy emitted by the radiating surface.

One or more additional embodiments of the present disclosure may be directed to a method for radiating sound. The method may comprise providing a speaker enclosure including a front surface having at least one front acoustic exit facing a target direction and a rear surface having at least one rear acoustic exit adapted to face a wall surface. The method may further include providing a low-frequency (LF) driver disposed in the speaker enclosure and adapted to emit LF acoustic energy that exits at least the front acoustic exit and the rear acoustic exit. The method may also include: generating a first LF energy wave front from the LF acoustic energy exiting the front acoustic exit and radiating directly in the target direction; generating a second LF energy wave front that lags the first LF energy wave front from the LF acoustic energy exiting the front acoustic exit and reflecting off the wall surface; and generating a third LF energy wave front that arrives between the first LF energy wave front and the second LF energy wave front from the LF acoustic energy exiting the rear acoustic exit and radiating directly in the target direction combined with the LF acoustic energy exiting the rear acoustic exit and reflecting off the wall surface.

According to one or more embodiments, the first LF energy wave front may have a magnitude of 0.80. The second LF energy wave front may have a magnitude of 0.50 and lag the first LF energy wave front by 3.70 milliseconds. The third LF energy wave front may have a magnitude of 1.65 and lag the first LF energy wave front by 1.35 milliseconds.

Providing a speaker enclosure may further comprise providing the speaker enclosure including at least one side surface having a side acoustic exit. Generating a first LF energy wave front may comprise generating the first LF energy wave front from the LF acoustic energy exiting the front acoustic exit and side acoustic exit and radiating directly in the target direction. Generating a second LF energy wave front that lags the first LF energy wave front may comprise generating the second LF energy wave front from the LF acoustic energy exiting the front acoustic exit and side acoustic exit and reflecting off the wall surface.

Further, providing a speaker enclosure may further comprise providing the speaker enclosure including a bottom surface having a bottom acoustic exit. Moreover, generating a third LF energy wave front that arrives between the first LF energy wave front and the second LF energy wave front may comprise generating the third LF energy wave front from the LF acoustic energy exiting the rear acoustic exit and the bottom acoustic exit and radiating directly in the target direction combined with the LF acoustic energy exiting the rear acoustic exit and the bottom acoustic exit and reflecting off the wall surface.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

There are numerous situations that require loudspeakers to be surface mounted on a wall. For clarity, surface mounted loudspeakers do not refer to "in-wall" loudspeakers that require cutting into the wall so that the loudspeaker effectively becomes part of the wall. Rather, surface mounted loudspeakers refer to on-wall loudspeakers that are self-contained and use some form of mount to secure them to the wall (or other) surface. The distance between the radiating opening of the loudspeaker and the wall itself becomes a critical dimension. In the frequency ranges where the loudspeaker radiation is omnidirectional, the acoustic interaction of the wall becomes a fundamental part of the loudspeaker characteristic behavior.

Figure 1:
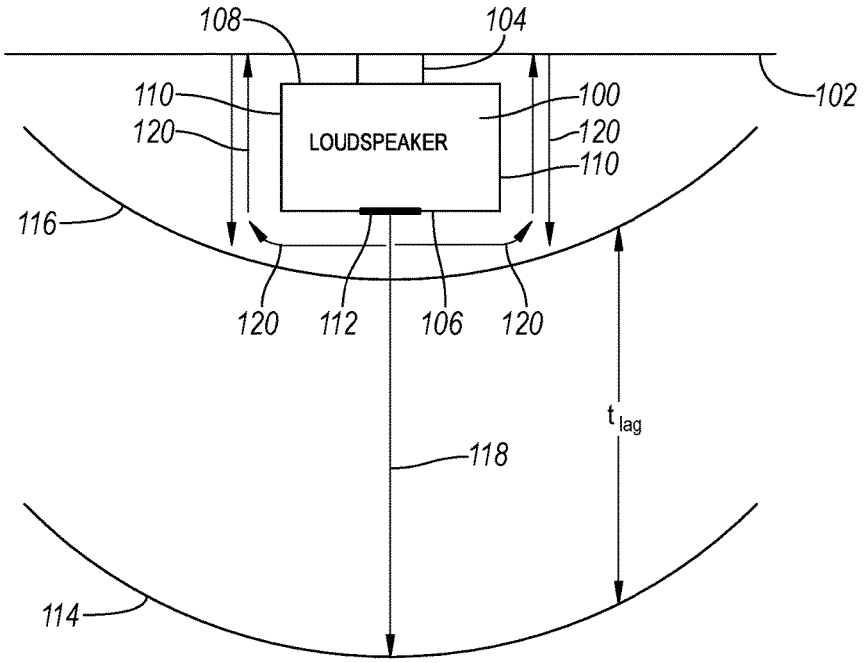
FIG. 1 is a top view of a surface-mounted loudspeaker in a room environment illustrating characteristic behavior in the frequency ranges where the loudspeaker acoustic radiation pattern is omnidirectional.

FIG. 1 is a top view of a surface-mounted loudspeaker 100 in a room environment. FIG. 1 illustrates a typical surface-mounted loudspeaker characteristic behavior in the frequency ranges where the loudspeaker acoustic radiation pattern is omnidirectional. As shown, the loudspeaker is mounted to a surface 102, such as a wall, using a mount 104.

The loudspeaker in this example includes a front surface 106 facing away from the wall surface 102 and in the target direction of an audience, a rear surface 108 that faces the wall surface 102, and two side surfaces 110. The loudspeaker in this example further includes a radiating opening 112 in the front surface.

In general and at any given snapshot in time, half of the omnidirectional energy radiated from the loudspeaker 100 is generally directed towards the audience, while the other half radiates towards the wall surface 102. Typical wall construction forms an acoustic reflector for the low frequency (LF) energy radiated toward the wall surface 102 because most absorption materials are not effective at low frequencies. The resulting energy contains two wave fronts—a direct (or primary) wave front 114 and a reflected wave front 116. Arrow 118 depicts a radiation path of LF acoustic energy contained in the direct wave front 114. Arrows 120 depict a radiation path of LF acoustic energy contained in the reflected wave front 116 around a perimeter (e.g., front surface 106 and side surfaces 110) of the loudspeaker. The direct wave front 114 and reflected wave 116 front are nearly equal in magnitude. However, there is a time lag ($t_{lag}$) between the reflected wave front 116 and the direct wave front 114 (i.e., the reflected wave front 116 lags the direct wave front 114 in time), as shown in FIG. 1. The lag relates directly with the speed of sound transit time from the radiating opening 112 of the loudspeaker 100 around the perimeter of the loudspeaker to the wall surface 102 and back. The nature of the reflected wave is a function of the loudspeaker and the acoustic characteristic of the wall surface 102.

For most traditional wall mounted loudspeakers in, for example, the professional cinema surround loudspeaker product class, the lag time between the direct wave front and the reflected wave front is typically in a range of 1-5 milliseconds. The actual lag time depends on the size of the mount and the size of the loudspeaker. For smaller class surface-mounted speakers, the lag time may be smaller. A 1-5 millisecond lag corresponds to 14-68 inch pathlength delta (i.e., the distance between the direct and reflected wave fronts). In or around this time range, the resulting sound experience may be affected negatively with certain frequencies being canceled out and others being accentuated. In the case of the canceled frequencies, electronic equalization cannot resolve the issue.

Figure 2:
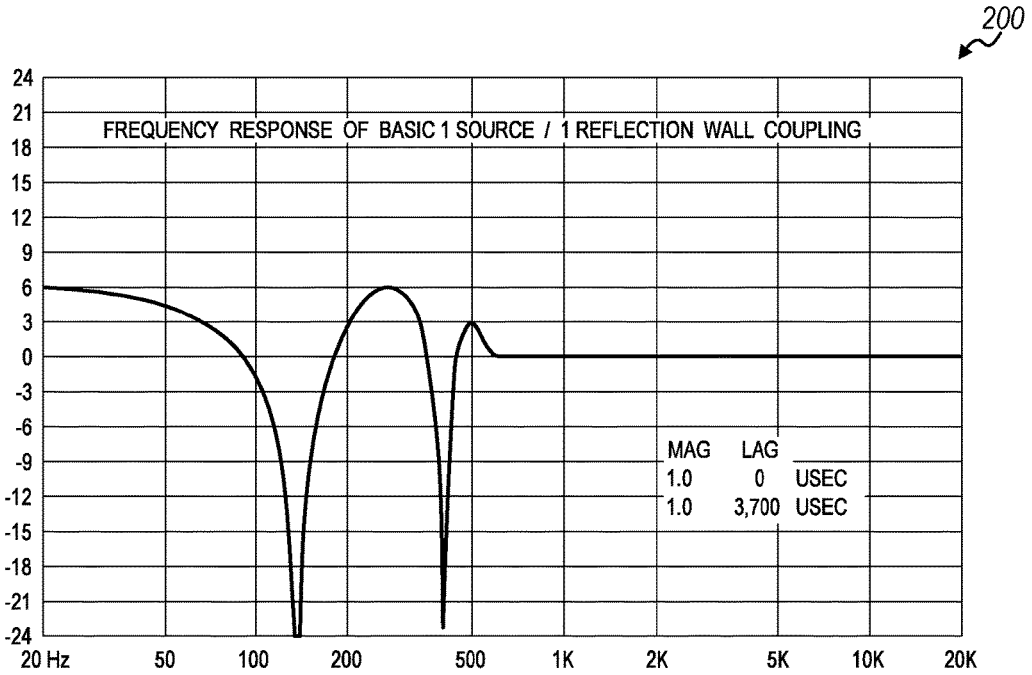
FIG. 2 is an exemplary plot showing the frequency response resulting from a 3.7 millisecond lag time reflected wave of a basic single source/single wall coupling speaker configuration.

FIG. 2 is an exemplary plot showing the frequency response 200 resulting from a 3.7 millisecond lag time reflected wave of a basic single source/single wall coupling speaker configuration, such as is described with respect to FIG. 1. The term "source," for purposes of this description, refers to any speaker element that radiates sound. A source can be either an acoustic exit (i.e., radiating opening) or a separate radiating element (called a driver). FIG. 2 shows the cancelled frequencies near 150 Hz and 400 Hz. There is an energy peak near 300 Hz. The primary wave front, without the reflection energy, would ideally be a flat line at 0 dB in this simulation. Thus, the reflected energy creates both the cancellations and the peaks. For reference, all simulations are intentionally made "flat" above 500 Hz to simplify the discussion.

There is benefit from the reflected energy when the lag times are relatively small in comparison to the wavelengths involved. When this is the case, the effective output of the loudspeaker is nearly doubled as the audience now receives all of the omnidirectional energy. This is evident from the frequency response curve in FIG. 2 for those frequencies below 60 Hz. One or more embodiments of the present disclosure utilize this property to resolve the cancellation problem by breaking the LF acoustic energy into multiple arrivals. Instead of a singular source, the loudspeaker design according to the present disclosure may use multiple sources in strategic locations on the speaker enclosure. The loudspeaker design of the present disclosure generates a series of wave fronts, both direct and reflected, with lag times between them strategically chosen to mitigate any discernible cancellations.

The loudspeaker design used to achieve a series of direct and reflected wave fronts having relatively small lag times sufficient to resolve the frequency cancellations can be executed in several different ways. According to one or more embodiments, the use of redirected energy from a single driver may be employed. According to one or more alternate embodiments, multiple drivers may be employed. Both designs can achieve similar results with the multiple driver implementations having the most design flexibility.

Figure 3:
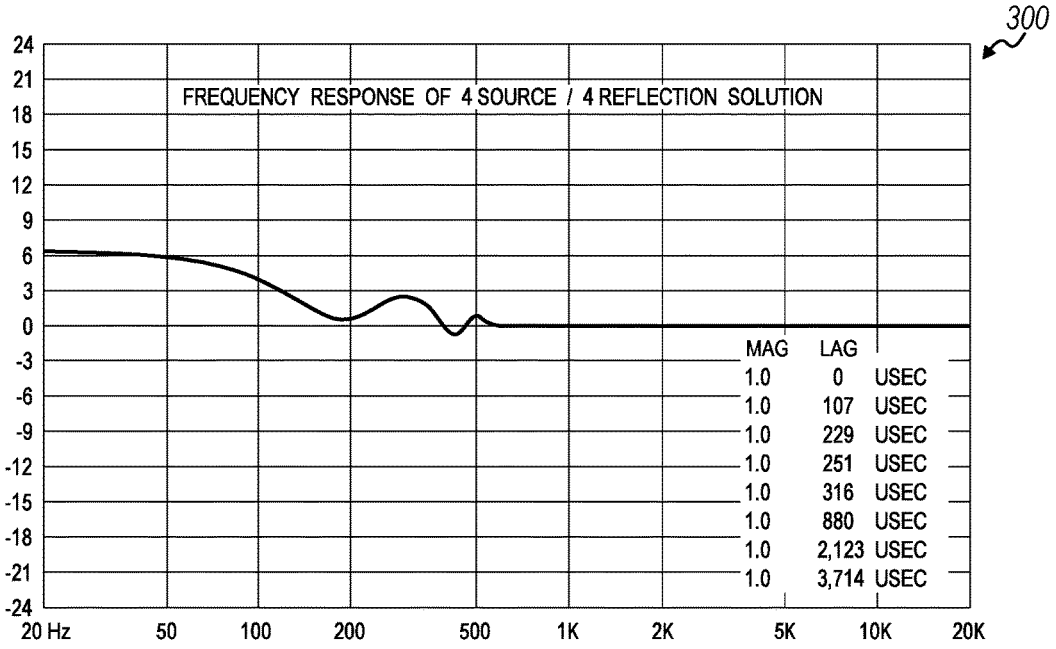
FIG. 3 is a plot showing the frequency response resulting from a design with four sources (and their four corresponding reflections) each with equal low-frequency (LF) energy magnitude, according to one or more embodiments of the present disclosure.
Figure 4:
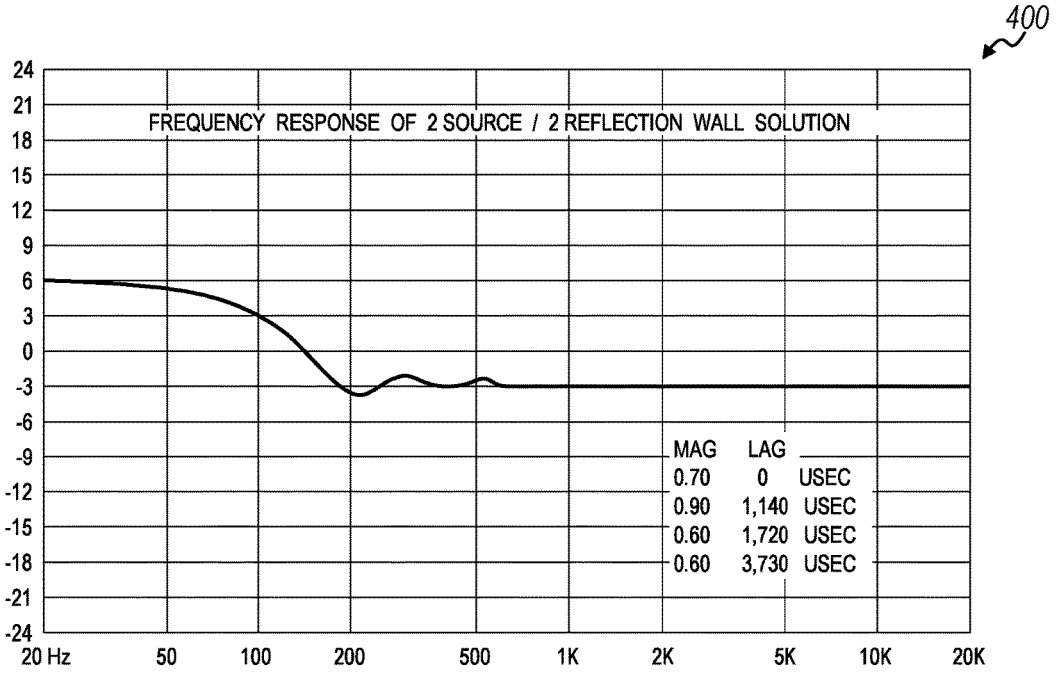
FIG. 4 is a plot showing the frequency response resulting from a design with two sources and two reflections, according to one or more embodiments of the present disclosure.
Figure 5:
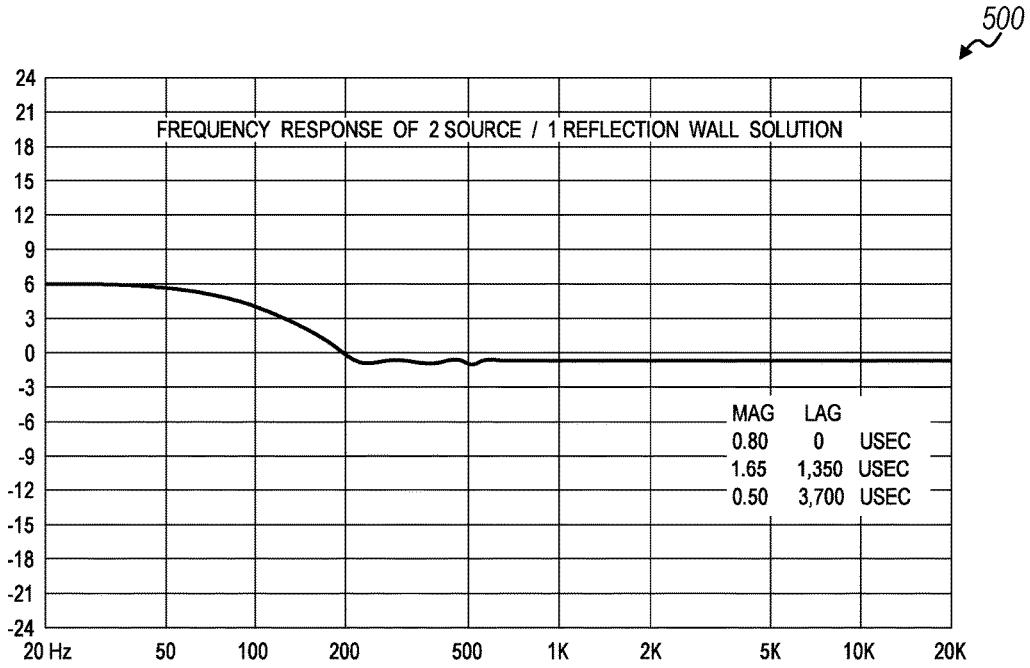
FIG. 5 is a plot showing the frequency response resulting from a design with two sources and one reflection according to one or more embodiments of the present disclosure.

The energy arrival lag times and their individual energy magnitudes cannot be arbitrary for good performance. With mathematical similarities to diffusion number theory, only certain combinations actually smooth the response and avoid severe cancelations and peaks. A computer optimizer routine may be employed to provide good results. Several simulations created using the optimizer routine and an actual product are shown in FIGS. 3-5. The three simulation solutions presented are based on different design variables and each provides different results. The corresponding magnitudes and lag times for each source or reflection is shown on each frequency response graph. All simulations are based on the same enclosure size and shape as modeled in the discussion above. In each case, new sources (and their associated wall reflections) are added with optimized magnitudes and lag times to mitigate the cancellation notches. Therefore, the primary LF acoustic energy and its 3.7 millisecond reflection are maintained in each solution.

FIG. 3 is a plot showing the frequency response 300 resulting from a design with four sources (and their four corresponding reflections) each with equal LF energy magnitude. This solution has the desirable property that there is only 6 dB differential between coherent summation and incoherent summation, which is a best case scenario. Coherent summation occurs when the wavelengths between summing energies are within a ¼ wavelength (e.g., everything below approx. 75 Hz in this scenario). Incoherent summation occurs when wavelengths of summing energies are more than ¼ wavelength (e.g., everything above approx. 100 Hz in this scenario). Executing a design with four sources and reflections with the level of precision required may be very difficult, but not impossible. The solutions simulated in FIGS. 4 and 5 may be simpler in nature and assume two sources, a primary and a secondary, which are considered practical and effective.

FIG. 4 illustrates a second solution showing the frequency response 400 resulting from a design with two sources and two reflections. The lag times shown are achievable if one source is on the front surface of the loudspeaker and the second is on the rear surface of the loudspeaker. This solution has 9 dB differential between coherent and incoherent summation, which could be useful in some designs.

FIG. 5 illustrates a third solution showing the frequency response 500 resulting from a design with two sources and one reflection. This solution is achievable with one source on the front surface of the loudspeaker and one source on the rear surface of the loudspeaker. In this case, the mount distance and location of the rear source are such the direct energy and its reflection are indistinguishable (e.g., <100 microsecond lag time). The summation of the direct energy and reflected energy will naturally be a factor 2× if the energies are truly coherent, which tracks with the magnitude shown. The overall response is very smooth and the 7 dB differential between coherent and incoherent summation is very good.

Figure 6:
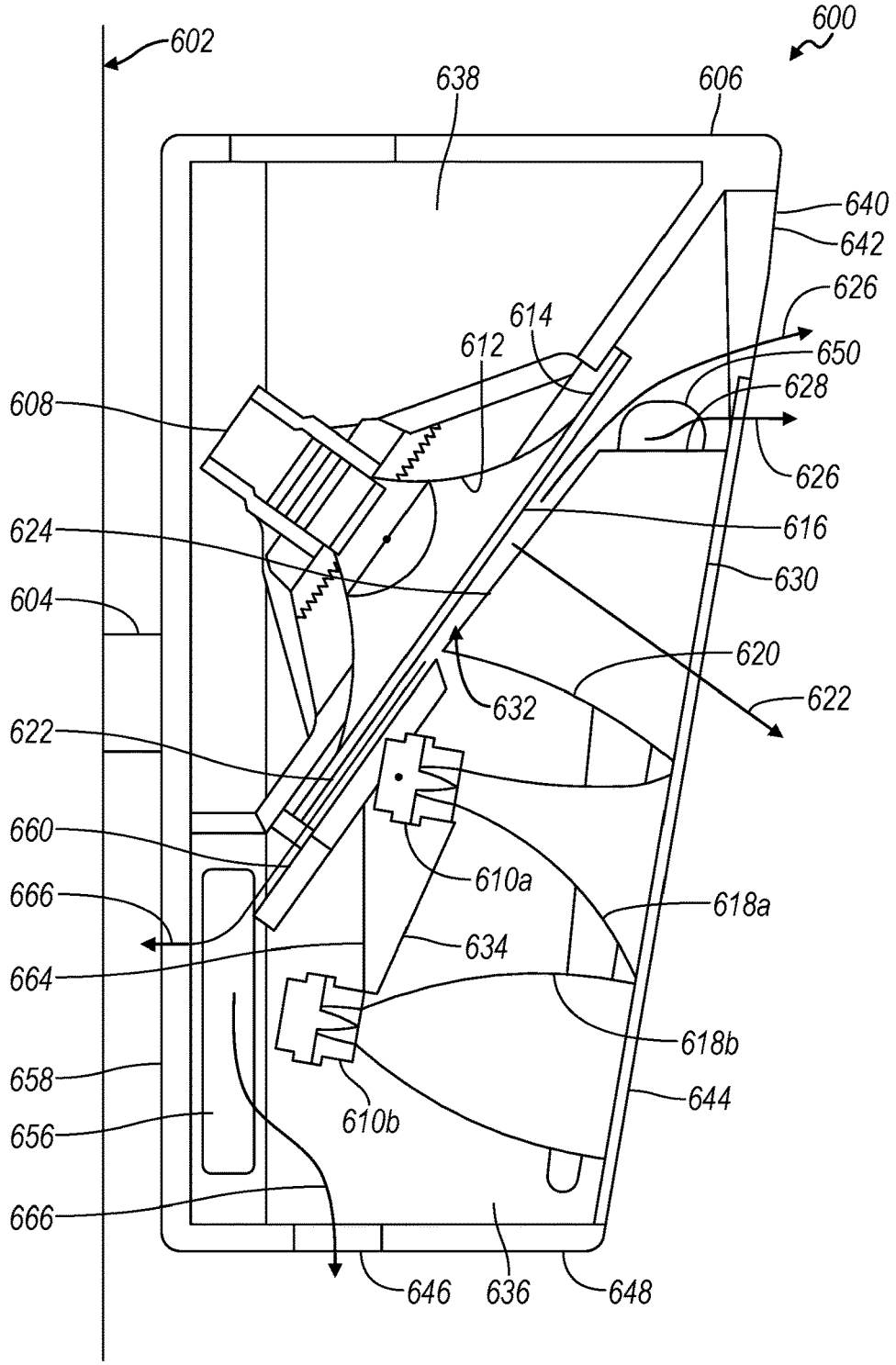
FIG. 6 is a side, cross-sectional view of a loudspeaker, according to one or more embodiments of the present disclosure.
Figure 7:
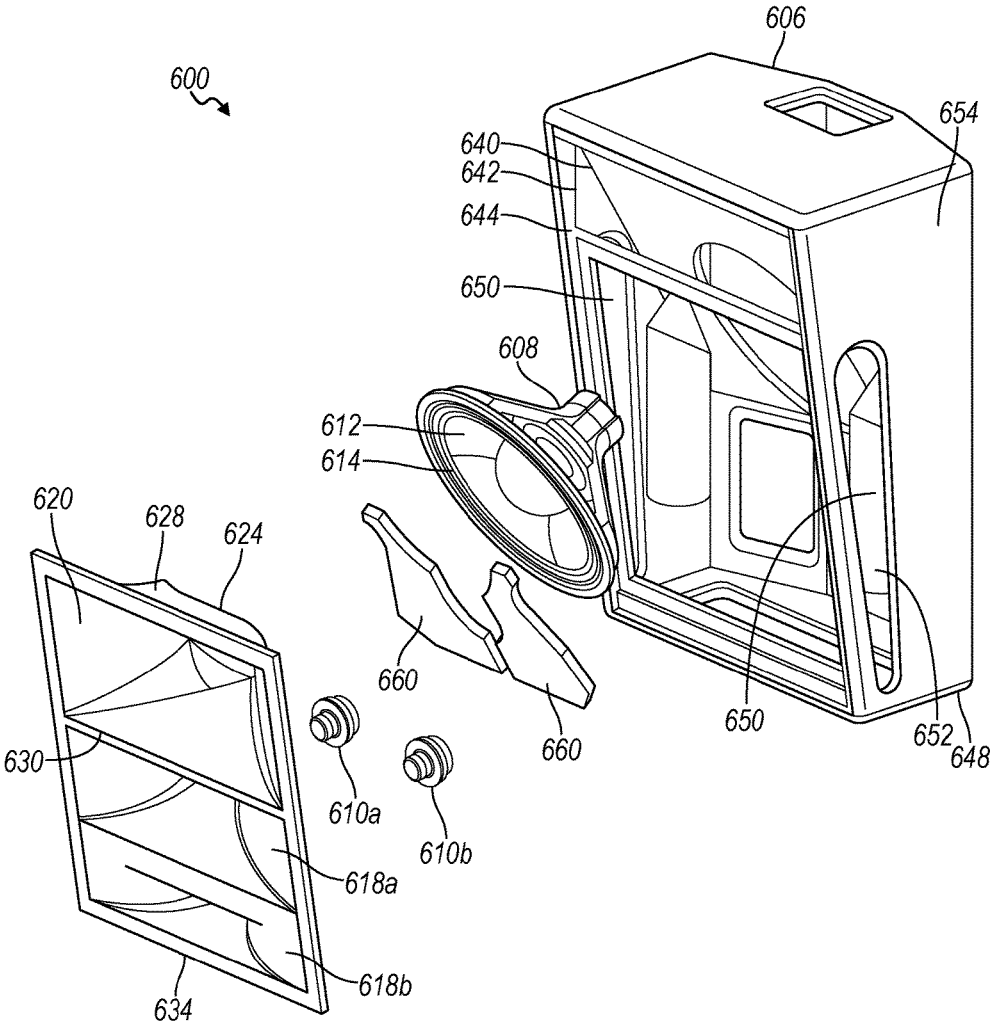
FIG. 7 is an exploded view of the loudspeaker illustrated in FIG. 6, according to one or more embodiments of the present disclosure.

FIGS. 6 and 7 show details of an exemplary loudspeaker 600 employing the solution simulated in FIG. 5. In particular, FIG. 6 is a side, cross-sectional view of the loudspeaker 600, while FIG. 7 is an exploded view of the loudspeaker 600 illustrated in FIG. 6. According to one or more embodiments, the loudspeaker 600 may be a professional cinema surround loudspeaker. However, other speaker classes may employ the various design techniques described herein and achieve similar results. Typical of professional cinema surrounds, the loudspeaker may surface mount to a wall surface 602 (e.g., a theater wall) with a mount 604 holding it between 4-8 inches off the wall. The loudspeaker 600 may be a two-way loudspeaker including a speaker enclosure 606, an LF driver 608 and at least one high-frequency (HF) driver 610. As shown, the at least one HF driver 610 may include a first HF driver 610*a* and a second HF driver 610*b*, both adapted to emit HF acoustic energy. However, the two-way loudspeaker design according to the present disclosure may be employed using only a single HF driver.

The LF driver 608 may include a radiating surface 612, sometimes referred to as a cone or diaphragm, adapted to emit LF acoustic energy. The radiating surface 612 moves like a piston to pump air and create sound waves in response to electrical audio signals. An outer circumference 614 of the radiating surface 612 may define a radiating surface opening 616 having a radiating surface opening area.

The LF driver 608 and the two HF drivers 610 may have corresponding waveguides to aid in directing acoustic energy. The first HF driver 610*a* may be physically coupled to a first HF waveguide 618*a* while the second HF driver 610*b* may be physically coupled to a second HF waveguide 618*b*. According to one or more embodiments of the present disclosure, the loudspeaker design may employ an LF waveguide 620 that is smaller than a traditional low frequency waveguide. The LF waveguide 620 defines a first radiation path 622 for the LF acoustic energy. The LF waveguide 620 may include a proximal opening 624 positioned adjacent to the LF driver 608 (coupling to the driver) that may be considerably smaller than the radiating surface 612 of the LF driver 608. The proximal opening 624 of the LF waveguide 620 may define a proximal opening area. Accordingly, the proximal opening area may be smaller than the radiating surface opening area. Because the proximal opening area may be smaller than the radiating surface opening area, this defines at least a second radiation path 626 for the LF acoustic energy around an outer surface 628 of the LF waveguide 620.

The LF waveguide 620 may extend away from the LF driver 608 to a distal opening 630 (coupling to free air) defining the first radiation path 622 therethrough. The distal opening 630 may define a distal opening area and be sized appropriate to waveguide design practice, as understood by one of ordinary skill in the art, and to support the directivity criteria. For instance, the distal opening area may be larger than the proximal opening area. In general, the larger the distal opening 630, the more control on directivity.

The LF waveguide 620 may float in front of the LF driver 608. A floating waveguide is not physically connected to its corresponding driver, but rather is detached from the LF driver. As illustrated in FIG. 6, the proximal opening 624 of the LF waveguide 620 may be spaced apart from the LF driver 608 by a distance to define an air gap 632 between the LF driver 608 and the LF waveguide 620. The air gap 632 may exist at least in part because the proximal opening area of the LF waveguide 620 may be smaller than the radiating surface opening area of the LF driver 608. Because the radiating surface 612 moves in response to electrical audio signals, the distance between the LF driver 608 and the LF waveguide 620—and, correspondingly, the size of the air gap 632—may vary.

By allowing the LF waveguide 620 to float may provide a means to effectively extract the higher frequencies from the radiating surface 612 of the LF driver 608 directly into the LF waveguide 620 (designed to support these frequencies) via the first radiation path 622 without the use of a compression chamber and without forcing all frequencies into the LF waveguide 620. Accordingly, frequencies not optimum for the LF waveguide 620 may be allowed a different radiation path, such as the second radiation path 626. Several paths may be necessary for good performance. These additional radiation paths may be created using numerous acoustical elements and are primarily formed to address different frequency regions.

The three waveguides (the LF waveguide 620 and two HF waveguides 618) may be formed from a triple waveguide body 634. The loudspeaker 600 may include two internal chambers—a front chamber 636 and a rear chamber 638. The rear chamber 638 may house the LF driver 608 in a vented box design. The front chamber 636 may be formed by enclosing the space directly in front of the LF driver 608 and behind the LF and HF waveguides. According to one or more embodiments, the front chamber 636 may include as many as seven (7) exit paths for LF acoustic energy. A primary acoustic exit may be the LF waveguide 620 itself, which may be a critical exit for the crossover frequencies via the first radiation path 622. Other acoustic exits in the loudspeaker 600 may include: a front acoustic exit 640 defined by a front opening 642 in a front surface 644 of the speaker enclosure 606 directly above the LF driver 608; a bottom acoustic exit 646 at a bottom surface 648 of the speaker enclosure 606; two side acoustic exits 650 defined by slender openings 652 in side surfaces 654 of the speaker enclosure 606 (see also FIG. 7); and two rear acoustic exits 656 in a rear surface 658 of the speaker enclosure 606.

In some embodiments, the LF waveguide 620 may be the only acoustic exit in the front surface 644 of the speaker enclosure 606, and may therefore be referred to as a front acoustic exit as well. In either case, the front acoustic exit 640 disposed in the front surface 644 may face a target direction, such as the direction of an audience. The rear acoustic exit 656 in the rear surface 658 of the speaker enclosure 606 may be adapted to face the wall surface 602.

As previously described, the proximal opening 624 of the LF waveguide 620 may be smaller than the radiating surface opening 616 of the LF driver 608. Floating the LF waveguide 620 may force only a portion of the LF acoustic energy from the LF driver 608 into the LF waveguide 620 via the first radiation path 622. Rather, the LF acoustic energy may be divided between the LF waveguide 620 via the first radiation path 622 and the other acoustic exits discussed above via at least the second radiation path 626.

The frequency region just below the effective operation of the LF waveguide 620 can be difficult to maintain in the design. These wavelengths may be small enough to be greatly affected by the obstructions in the front chamber 636 and may also have difficulty aligning to the LF waveguide energy. Three acoustic exits may be primary for these frequencies that are just below the effective operation of the LF waveguide 620. They may include the front acoustic exit 640 adjacent to the LF waveguide 620 and the two side acoustic exits 650 on the side surfaces 654 of the loudspeaker 600 (FIG. 7). The front acoustic exit 640 may provide a very direct radiation path out for the LF acoustic energy on upper edges of the radiating surface 612. This exit meets the ¼ wavelength requirement for all frequencies produced by the LF driver 608. The slender side acoustic exits 650 may be very specific to a small portion of LF acoustic energy from left and right rim portions of the radiating surface 612. Thus, the second radiation path 626 may be further defined by LF acoustic energy radiating around the outer surface 628 of the LF waveguide 620 and exiting the front acoustic exit 640 adjacent the LF waveguide 620 and/or exiting the side acoustic exits 650.

According to one or more embodiments, the loudspeaker 600 may include a load plate 660 disposed in front of a portion of the radiating surface 612, such as a bottom portion 662. Accordingly, the load plate 660 may be disposed adjacent to the proximal opening 624 of the LF waveguide 620. In this manner, along with the first HF driver 610*a*, the load plate 660 may obstruct a portion of the LF acoustic energy emitted by the LF driver 608. The load plate 660 may accomplish several important functions. For instance, the load plate 660 may provide a safe landing for acoustical treatment between the waveguides 618, 620 and the LF driver 608 critical to suppressing crossover energy trapped in the front chamber 636. The load plate 660 may also prevent LF acoustic energy from directly pressurizing a rear surface 664 of the triple waveguide body 634. The load plate 660 may provide a third radiation path 666 out of the front chamber 636 and to the rear acoustic exits 656 and/or the bottom acoustic exit 646 by deflecting LF acoustic energy from the bottom portion 662 of the radiating surface 612 of the LF driver 608. The design may allow rear chamber vents to radiate into the front chamber 636. Alternatively, the rear chamber vents may radiate directly into free air. FIGS. 6 and 7 specifically illustrate the details of the redirect mechanisms (e.g., the load plate 660, triple waveguide body 634, and front chamber enclosure) for LF energy employed in the loudspeaker design.

One or more applications for the loudspeaker product (e.g., professional cinema surrounds) is such that the acoustical energy below the loudspeaker 600 may be the most important (towards audience) and, therefore, a target axis of the loudspeaker may be approximately 30° down from horizontal. In this orientation, and particularly at angles between 30° and 60° down, the loudspeaker exit lag times are similar to the solution simulated in FIG. 5 described above.

Figure 8:
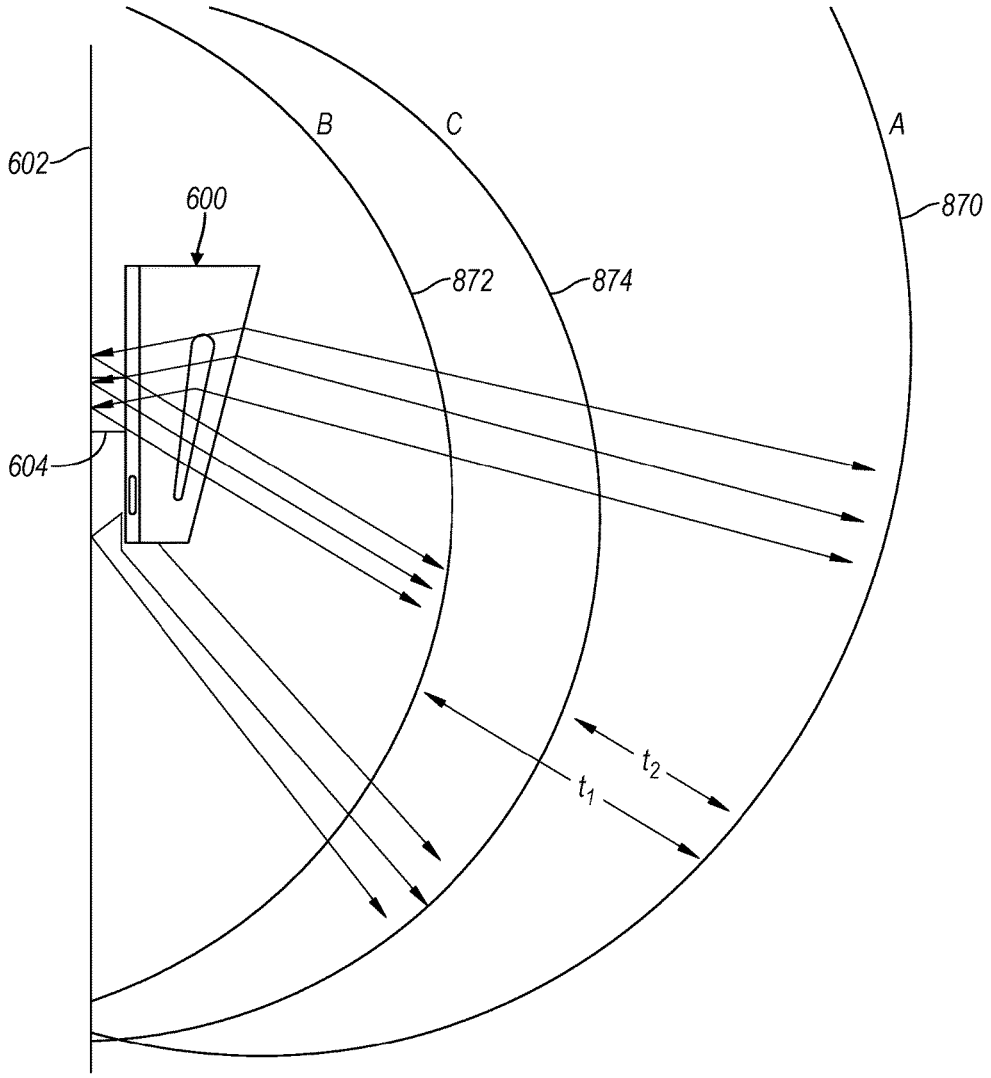
FIG. 8 is an interpretive side view of the LF wave front arrivals illustrating the characteristic behavior of the loudspeaker in the frequency ranges where the loudspeaker acoustic radiation pattern is omnidirectional, according to one or more embodiments of the present disclosure.

FIG. 8 is an interpretive side view of LF energy wave front arrivals illustrating the characteristic behavior of the loudspeaker 600 in the frequency ranges where the loudspeaker acoustic radiation pattern is omnidirectional. The LF acoustic energy exiting the LF waveguide 620, the front acoustic exit 640, and the side acoustic exits 650 may be close enough in time (e.g., within 100 microseconds) to act as one arrival, A, forming a first LF energy wave front 870. Referring back to FIG. 5, the magnitude of the first LF energy wave front may be approximately 0.80. The corresponding reflections from the wall surface 602 of LF acoustic energy exiting the LF waveguide 620, the front acoustic exit 640, and the side acoustic exits 650, likewise, may act as a second unified arrival, B, forming a second LF energy wave front 872 that lags the first LF energy wave front 870 by a first lag time ($t_1$). As noted in FIG. 5, the magnitude of the second LF energy wave front 872 may be approximately 0.50 and the first lag time $t_1$ may be approximately 3.70 milliseconds. The LF acoustic energy exiting the rear acoustic exits 656 and the bottom acoustic exit 646 and their corresponding wall surface reflections may all be close enough in time to also act as one arrival, C, forming a third LF energy wave front 874 that lags the first LF energy wave front 870 by a second lag time ($t_2$). The third LF energy wave front 874 may arrive between the first LF energy wave front 870 and the second LF energy wave front 872 (i.e., $t_2<t_1$). As noted in FIG. 5, the magnitude of the third LF energy wave front 874 may be approximately 1.65 and the second lag time $t_2$ may be approximately 1.35 milliseconds. The direct and reflected LF acoustic energy exiting the rear acoustic exits 656 and the bottom acoustic exit 646 act as one unified arrival due to their proximity to the wall surface 602. Therefore, three major LF energy wave front arrivals may exist—2 source (A and C) and 1 reflection (B)—at these target angles with favorable lag times, mitigating any cancellation notching that occurs in conventional surface-mounted loudspeaker designs.

Figure 9:
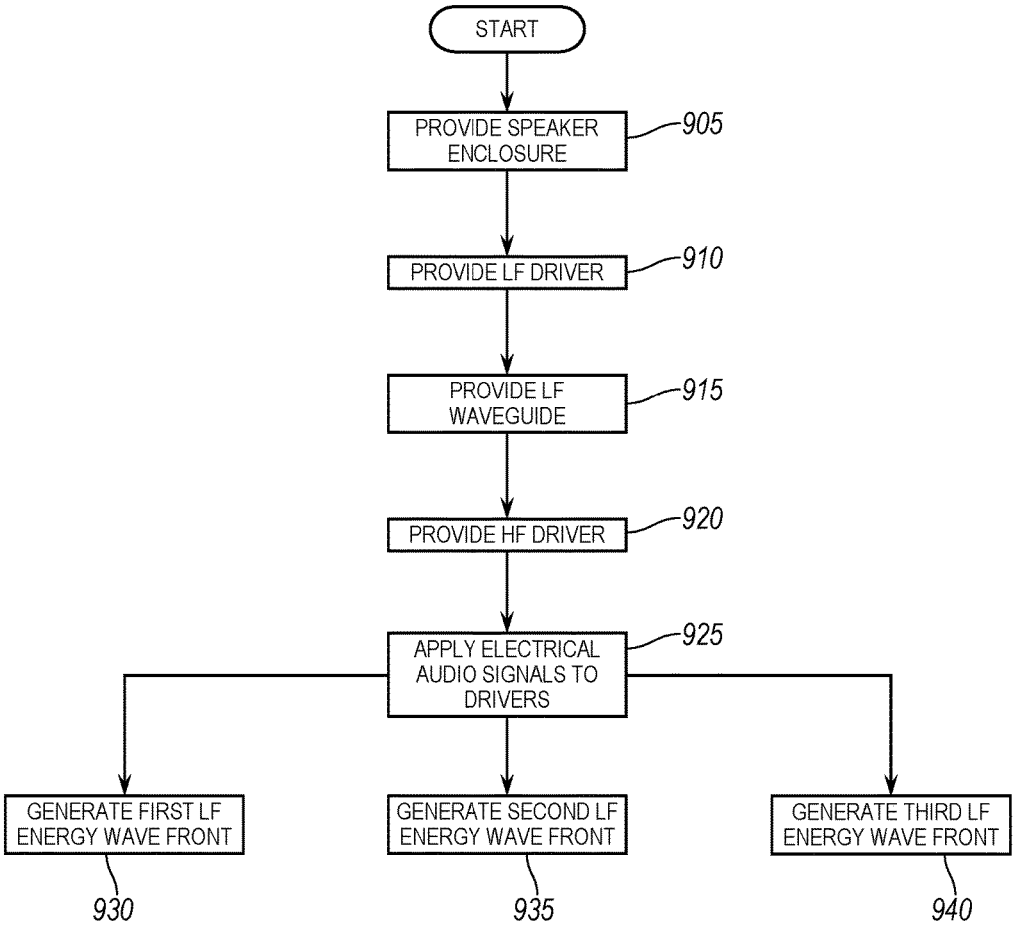
FIG. 9 is a simplified, exemplary flow chart depicting a method for radiating sound, according to one or more embodiments of the present disclosure.

FIG. 9 is a simplified, exemplary flow chart depicting a method for radiating sound, according to one or more embodiments of the present disclosure. The method may include providing the loudspeaker 600 including the speaker enclosure 606 having a number of acoustic exits, as provided at step 905. A primary acoustic exit may be the LF waveguide 620. Other acoustic exits in the loudspeaker 600 may include: the front acoustic exit 640 in the front surface 644 of the speaker enclosure 606; the bottom acoustic exit 646 at the bottom surface 648 of the speaker enclosure 606; two side acoustic exits 650 in side surfaces 654 of the speaker enclosure 606; and at least one rear acoustic exit 656 in the rear surface 658 of the speaker enclosure 606. The front surface 644 may have at least one front acoustic exit facing the target direction, which may include the LF waveguide 620, and the rear surface 658 may have at least one rear acoustic exit adapted to face a wall surface 602.

The method may further include providing the LF driver 608 disposed in the speaker enclosure 606 and adapted to emit LF acoustic energy that exits one or more of the front acoustic exit 640, the side acoustic exits 650, the rear acoustic exit 656, and the bottom acoustic exit 646, as provided at step 910. According to one or more embodiments, the method may further include providing the LF waveguide 620 coupled to the LF driver 608, as provided at step 915. As set forth above, the LF waveguide 620 may not be physically connected to the LF driver 608 so that only a portion of the LF acoustic energy exits the loudspeaker enclosure via the LF waveguide. The method may also include providing at least one HF driver 610 disposed in the speaker enclosure 606 for emitting HF acoustic energy, as provided at step 920.

At step 925, electrical audio signals may be applied to the LF and HF drivers 608, 610 causing them to produce LF and HF acoustic energy, respectively. At step 930, the first LF energy wave front 870 may be generated from the LF acoustic energy exiting at least the front acoustic exit 640 and radiating directly in the target direction. The first LF energy wave front 870 may also include LF acoustic energy exiting the side acoustic exits 650 and radiating directly in the target direction. At step 935, the second LF energy wave front 872 that lags the first LF energy wave front 870 may be generated from the LF acoustic energy exiting the front acoustic exit 640 and reflecting off the wall surface 602. The second LF energy wave front 872 may also include LF acoustic energy exiting the side acoustic exits 650 and reflecting off the wall surface 602. At step 940, the third LF energy wave front 874 that arrives between the first LF energy wave front 870 and the second LF energy wave front 872 may be generated from the LF acoustic energy exiting the rear acoustic exit 656 and radiating directly in the target direction combined with the LF acoustic energy exiting the rear acoustic exit 656 and reflecting off the wall surface 602. The third LF energy wave front 874 may also include LF acoustic energy exiting the bottom acoustic exit 646 and radiating directly in the target direction combined with the LF acoustic energy exiting the bottom acoustic exit 646 and reflecting off the wall surface 602.

Figure 10:
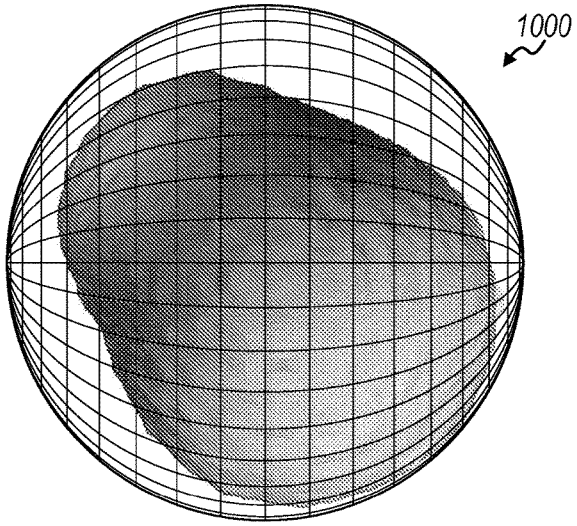
FIG. 10 is an actual 200 Hz radiation balloon of the loudspeaker depicted in FIGS. 6 and 7, according to one or more embodiments of the present disclosure.

FIG. 10 is the actual 200 Hz radiation balloon 1000 of the loudspeaker depicted in FIGS. 6 and 7. Further evidence of the two source arrangement within the loudspeaker 600 is the radiation pattern of the loudspeaker shown in FIG. 10. The downward tilt in the pattern is not possible with one omnidirectional source. The radiation pattern is a result of the combination of sources presenting two wave fronts which sum together on the downward angles. It should be noted that the radiation balloon was measured with no wall interaction present but does indicate the presence of two sources.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A loudspeaker comprising:

a speaker enclosure adapted for surface-mounting and including a front surface having at least one front acoustic exit facing a target direction and a rear surface having at least one rear acoustic exit adapted to face a wall surface; and a low-frequency (LF) driver disposed in the speaker enclosure and adapted to emit LF acoustic energy that exits at least the front acoustic exit and the rear acoustic exit, the LF acoustic energy exiting the front acoustic exit and radiating directly in the target direction forming a first LF energy wave front, the LF acoustic energy exiting the front acoustic exit and reflecting off the wall surface forming a second LF energy wave front that lags the first LF energy wave front, the LF acoustic energy exiting the rear acoustic exit and radiating directly in the target direction combined with the LF acoustic energy exiting the rear acoustic exit and reflecting off the wall surface forming a third LF energy wave front that arrives between the first LF energy wave front and the second LF energy wave front.

2. The loudspeaker of claim 1, wherein the first LF energy wave front has a magnitude of 0.80, the second LF energy wave front has a magnitude of 0.50 and lags the first LF energy wave front by 3.70 milliseconds, and the third LF energy wave front has a magnitude of 1.65 and lags the first LF energy wave front by 1.35 milliseconds.

3. The loudspeaker of claim 1, wherein the speaker enclosure further comprises at least one side surface having a side acoustic exit, the LF acoustic energy exiting the side acoustic exit and radiating in the target direction forming part of the first LF energy wave front, the LF acoustic energy exiting the side acoustic exit and reflecting off the wall surface forming part of the second LF energy wave front that lags the first LF energy wave front.

4. The loudspeaker of claim 1, wherein the speaker enclosure further comprises a bottom surface having a bottom acoustic exit, the LF acoustic energy exiting the bottom acoustic exit and radiating directly in the target direction combined with the LF acoustic energy exiting the bottom acoustic exit and reflecting off the wall surface forming part of the third LF energy wave front that arrives between the first LF energy wave front and the second LF energy wave front.

5. The loudspeaker of claim 1, further comprising:

an LF waveguide coupled to the LF driver defining a first radiation path for the LF acoustic energy, wherein the at least one front acoustic exit includes the LF waveguide.

6. The loudspeaker of claim 5, wherein the at least one front acoustic exit includes a front opening in the speaker enclosure above the LF waveguide.

7. The loudspeaker of claim 6, the LF waveguide having a proximal opening positioned adjacent to the LF driver and extending away from the LF driver to a distal opening to define the first radiation path therethough, the proximal opening having a proximal opening area that is smaller than a radiating surface opening area to define a second radiation path for the LF acoustic energy around the LF waveguide and out the front opening.

8. The loudspeaker of claim 7, further comprising:

a load plate directly in front of a bottom portion of the radiating surface and adjacent the LF waveguide to deflect a portion of the LF acoustic energy along a third radiation path to the rear acoustic exit.

9. A loudspeaker comprising:

a speaker enclosure including a front surface having a front acoustic exit, at least one side surface having a side acoustic exit, a rear surface having at least one rear acoustic exit, and a bottom surface having a bottom acoustic exit;

a low-frequency (LF) driver disposed in the speaker enclosure and having a radiating surface adapted to emit LF acoustic energy and a radiating surface opening defined by an outer circumference of the radiating surface;

an LF waveguide defining a first radiation path for the LF acoustic energy, the LF waveguide having a proximal opening positioned adjacent to the LF driver and extending away from the LF driver to a distal opening to define the first radiation path therethough, the proximal opening having a proximal opening area that is smaller than a radiating surface opening area to define a second radiation path for the LF acoustic energy around the LF waveguide and out the front acoustic exit and the side acoustic exit; and a load plate directly in front of a bottom portion of the radiating surface and adjacent the LF waveguide to deflect a portion of the LF acoustic energy along a third radiation path to the rear acoustic exit and the bottom acoustic exit.

10. The loudspeaker of claim 9, wherein a target axis of the loudspeaker is approximately 30° down from horizontal.

11. The loudspeaker of claim 9, wherein a target axis of the loudspeaker is between 30° and 60° down from horizontal.

12. The loudspeaker of claim 9, further comprising at least one high-frequency (HF) driver disposed in the speaker enclosure.

13. The loudspeaker of claim 12, wherein the at least one HF driver comprises a first HF driver coupled to a first HF waveguide and a second HF driver coupled to a second HF waveguide.

14. The loudspeaker of claim 13, wherein the LF waveguide, the first HF waveguide, and the second HF waveguide are formed from a triple waveguide body.

15. A method for radiating sound comprising:

providing a speaker enclosure including a front surface having at least one front acoustic exit facing a target direction and a rear surface having at least one rear acoustic exit adapted to face a wall surface;

providing a low-frequency (LF) driver disposed in the speaker enclosure and adapted to emit LF acoustic energy that exits at least the front acoustic exit and the rear acoustic exit;

generating a first LF energy wave front from the LF acoustic energy exiting the front acoustic exit and radiating directly in the target direction;

generating a second LF energy wave front that lags the first LF energy wave front from the LF acoustic energy exiting the front acoustic exit and reflecting off the wall surface; and generating a third LF energy wave front that arrives between the first LF energy wave front and the second LF energy wave front from the LF acoustic energy exiting the rear acoustic exit and radiating directly in the target direction combined with the LF acoustic energy exiting the rear acoustic exit and reflecting off the wall surface.

16. The method of claim 15, wherein the first LF energy wave front has a magnitude of 0.80, the second LF energy wave front has a magnitude of 0.50 and lags the first LF energy wave front by 3.70 milliseconds, and the third LF energy wave front has a magnitude of 1.65 and lags the first LF energy wave front by 1.35 milliseconds.

17. The method of claim 15, wherein providing a speaker enclosure further comprises providing the speaker enclosure including at least one side surface having a side acoustic exit.

18. The method of claim 17, wherein generating a first LF energy wave front comprises generating the first LF energy wave front from the LF acoustic energy exiting the front acoustic exit and side acoustic exit and radiating directly in the target direction.

19. The method of claim 17, wherein generating a second LF energy wave front that lags the first LF energy wave front comprises generating the second LF energy wave front from the LF acoustic energy exiting the front acoustic exit and side acoustic exit and reflecting off the wall surface.

20. The method of claim 15, wherein providing a speaker enclosure further comprises providing the speaker enclosure including a bottom surface having a bottom acoustic exit; and wherein generating a third LF energy wave front that arrives between the first LF energy wave front and the second LF energy wave front comprises generating the third LF energy wave front from the LF acoustic energy exiting the rear acoustic exit and the bottom acoustic exit and radiating directly in the target direction combined with the LF acoustic energy exiting the rear acoustic exit and the bottom acoustic exit and reflecting off the wall surface.

* * * * *